US011517164B2

(12) United States Patent
Na et al.

(10) Patent No.: US 11,517,164 B2
(45) Date of Patent: Dec. 6, 2022

(54) ROBOT CLEANER, STATION, AND CLEANING SYSTEM

(71) Applicant: SAMSUNG ELECTRONICS CO., LTD., Suwon-si (KR)

(72) Inventors: Woo Jin Na, Suwon-si (KR); Hakbong Lee, Suwon-si (KR); Bosang Kim, Suwon-si (KR); Sin-Ae Kim, Suwon-si (KR); Yong-Seok Kim, Suwon-si (KR); Yeonkyu Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 349 days.

(21) Appl. No.: 16/911,857

(22) Filed: Jun. 25, 2020

(65) Prior Publication Data

US 2020/0405107 A1 Dec. 31, 2020

(30) Foreign Application Priority Data

Jun. 25, 2019 (KR) ..... 10-2019-0075417

(51) Int. Cl.
*A47L 9/14* (2006.01)
*A47L 5/22* (2006.01)
(Continued)

(52) U.S. Cl.
CPC ..... *A47L 9/149* (2013.01); *A47L 5/22* (2013.01); *A47L 9/106* (2013.01); *A47L 9/2815* (2013.01);
(Continued)

(58) Field of Classification Search
CPC . A47L 5/225; A47L 5/36; A47L 9/106; A47L 9/20; A47L 9/242; A47L 9/2873
See application file for complete search history.

(56) References Cited

U.S. PATENT DOCUMENTS 9,907,447 B2 * 3/2018 Tanaka ..... A47L 9/2873
2005/0150519 A1 * 7/2005 Keppler ..... A47L 5/38 15/340.3
(Continued)

FOREIGN PATENT DOCUMENTS

CA 2317598 A1 * 7/1999
DE 102010000607 A1 * 9/2011 ..... A47L 5/225
(Continued)

OTHER PUBLICATIONS

Extended European Search Report dated May 4, 2022 in European Patent Application No. 20832895.5 (5 pages).
(Continued)

*Primary Examiner* — Marc Carlson
(74) *Attorney, Agent, or Firm* — Staas & Halsey LLP

(57) ABSTRACT

Provided is a cleaning system including: a robot cleaner including a dust collecting device having a dirt outlet and an outlet door configured to open and close the dirt outlet; and a station including a collecting device configured to generate a suction force to suction dirt of the duct collecting device and a lever device provided with a lever configured to be fixable to the outlet door as the outlet door is being opened to allow the collecting device and the dust collecting device to communicate with each other, and a lever driving source configured to generate power for driving the lever.

20 Claims, 14 Drawing Sheets

(51) Int. Cl.
*A47L 9/28* (2006.01)
*A47L 9/10* (2006.01)

(52) U.S. Cl.
CPC ..... *A47L 9/2836* (2013.01); *A47L 9/2873* (2013.01); *A47L 9/2884* (2013.01); *A47L 2201/022* (2013.01); *A47L 2201/024* (2013.01)

(56) References Cited

U.S. PATENT DOCUMENTS

2005/0212478 A1* 9/2005 Takenaka ..... G05D 1/0246 318/587
2007/0157416 A1* 7/2007 Lee ..... A47L 9/2894 15/328
2007/0226949 A1* 10/2007 Hahm ..... A47L 9/009 15/340.1
2007/0245511 A1* 10/2007 Hahm ..... A47L 9/106 134/21
2009/0049640 A1* 2/2009 Lee ..... A47L 9/20 901/1
2012/0291809 A1* 11/2012 Kuhe ..... A47L 5/24 134/18
2016/0278596 A1* 9/2016 Janzen ..... A47L 11/4066
2017/0150861 A1* 6/2017 Tanaka ..... A47L 9/2894
2017/0196430 A1* 7/2017 Machida ..... A47L 9/106
2018/0029809 A1* 2/2018 Lee ..... A47L 9/0477
2019/0133399 A1* 5/2019 Morin ..... A47L 9/149
2019/0231160 A1* 8/2019 Lu ..... A47L 9/2873
2020/0022553 A1* 1/2020 Gill ..... A47L 9/2805
2020/0187736 A1* 6/2020 Jeong ..... A47L 9/2873
2020/0229667 A1* 7/2020 Yun ..... A47L 9/1683
2020/0315419 A1* 10/2020 Sato ..... A47L 5/36
2020/0405107 A1* 12/2020 Na ..... A47L 9/2884

FOREIGN PATENT DOCUMENTS

DE 102010061327 A1 * 6/2012 ..... A47L 9/106
EP 1961358 A2 * 8/2008 ..... A47L 9/106
EP 3033982 A1 * 6/2016 ..... A47L 5/38
EP 3 165 147 A1 5/2017
KR 10-2003-0058053 7/2003
KR 10-2007-0099359 10/2007
KR 10-2010-0128839 12/2010
KR 10-2012-0007943 1/2012
WO WO-2007137234 A2 * 11/2007 ..... A47L 11/24
WO WO-2017047291 A1 * 3/2017 ..... A47L 7/0047
WO WO-2018100773 A1 * 6/2018 ..... A47L 5/225

OTHER PUBLICATIONS

International Search Report dated Sep. 29, 2020 in International Patent Application No. PCT/KR2020/007636.

* cited by examiner

ROBOT CLEANER, STATION, AND CLEANING SYSTEM

CROSS-REFERENCE TO RELATED APPLICATION

This application is based on and claims priority under 35 U.S.C. § 119 to Korean Patent Application No. 10-2019-0075417, filed on Jun. 25, 2019, in the Korean Intellectual Property Office, the disclosure of which is incorporated herein by reference.

BACKGROUND

1. Field

The disclosure relates to a robot cleaner, a station, and a cleaning system, and more specifically, to a robot cleaner having a dust collecting device, a station having a collecting device, and a cleaning system including the robot cleaner and the station.

2. Description of the Related Art

In general, a robot cleaner is an appliance that moves in a cleaning space without a user's manipulation while sucking up dirt accumulated on the floor to thereby automatically clean the cleaning space. The robot cleaner cleans the cleaning space while running on the cleaning space.

The robot cleaner determines the distance to an obstacle, such as furniture, office supplies, and walls installed in a cleaning area, through a distance sensor, and selectively drives a left wheel motor and a right wheel motor of the robot cleaner so that the robot cleaner cleans the cleaning area by changing directions by itself.

The robot cleaner may clean the floor using a cleaning pad equipped with a wet cloth or a dry cloth, or may clean the floor using a dust collecting device.

The robot cleaner cleaning the floor through the dust collecting device may include a dust collecting chamber. The dirt collected in the dust collecting chamber may be manually emptied by the user or may be automatically emptied by a collecting device provided at a station.

SUMMARY

In accordance with one aspect of the disclosure, there is provided a cleaning system including: a robot cleaner including a dust collecting device having a dirt outlet and an outlet door configured to open and close the dirt outlet; and a station including a collecting device configured to generate a suction force to suction dirt of the duct collecting device and a lever device provided with a lever configured to be fixable to the outlet door as the outlet door is being opened to allow the collecting device and with the dust collecting device to communicate with each other, and a lever driving source configured to generate power to drive the lever.

The outlet door may include a door magnetic body, and the lever may include a lever magnetic body that allows an attractive force to act with the door magnetic body.

The lever may be movable between a first position in which the lever comes into contact with the outlet door that is in a closed state and a second position in which the lever moves with the outlet door as the outlet door is being opened.

The lever may be movable from the second position to a third position, and when the lever moves to the third position, the outlet door may be separated from the lever.

The lever device may include a release member configured to restrict a movement of the outlet door when the lever moves to the third position.

The lever device may include: a first link rotatable by receiving power from the lever driving source; a connecting member moved by a rotation of the first link; a second link rotatable by a movement of the connecting member; and a shaft configured to transfer rotary force of the second link to the lever.

The outlet door may be provided to be elastically biased in a direction toward the dirt outlet.

The outlet door may be formed of material having an elasticity, and the robot cleaner may include a door support that supports the outlet door in the direction toward the dirt outlet.

The robot cleaner may include a door elastic member that elastically supports the outlet door in the direction toward the dirt outlet.

The robot cleaner may include a display that is arranged at an end portion of the robot cleaner facing away from a direction in which the robot cleaner is docked to the station.

The station may include a station controller configured to control the lever device, and the station controller may be provided to drive the lever driving source when the robot cleaner is seated on the station.

When the robot cleaner is seated on the station, the station controller may control the lever driving source for the lever to move toward the outlet door and be fixed to the outlet door, and then move the lever in a direction in which the outlet door opens to thereby open the outlet door.

When collecting of dirt in the dust collecting device of the robot cleaner is completed, the station controller may control the lever driving source for the lever to further move in the direction in which the outlet door opens such that the outlet door is separated from the lever.

The station may include a cleaner seating portion on which the robot cleaner is seated, and the cleaner seating portion may be provided with a station charging terminal electrically connectable with the robot cleaner to charge a battery provided in the robot cleaner.

The station controller may control the station to charge the battery when driving the lever driving source.

In accordance with another aspect of the disclosure, there is provided a station including: a cleaner seating portion on which a robot cleaner is seated, the cleaner seating portion including a guide member configured to communicate with a dust collection device provided in the robot cleaner; a collecting device configured to generate a suction force to suction dirt of the dust collecting device; and a lever device including a lever configured to be fixable to an outlet door provided to open and close the dust collecting device, the lever being fixed to the outlet door as the outlet door opens, and a lever driving source configured to generate power to drive the lever.

The lever may include a lever magnetic body.

The lever may be movable to one of a first position in which the lever is fixed to the outlet door that is in a closed state, a second position in which the lever moves with the outlet door as the outlet door is being opened, and a third position in which the lever is separated from the outlet door.

The station may further include a station controller configured to control the lever device, while the robot cleaner is seated on the seating portion, wherein the station controller may control the lever driving source for the lever to move toward the outlet door and be fixed to the outlet door, and then move in a direction in which the outlet door opens to thereby open the outlet door.

In accordance with another aspect of the disclosure, there is provided a robot cleaner including: a cleaner inlet formed to face a surface to be cleaned; a cleaner suction device configured to generate a suction force to suction dirt; a dust collecting device in which dirt introduced through the cleaner inlet is collected, and the dust collecting device having a dirt outlet; and an outlet door configured to open and close the dirt outlet, the outlet door being configured to be elastically biased in a direction in which the dirt outlet is being opened, and to be moved due to a magnetic force applied to a door magnetic body of the outlet door.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
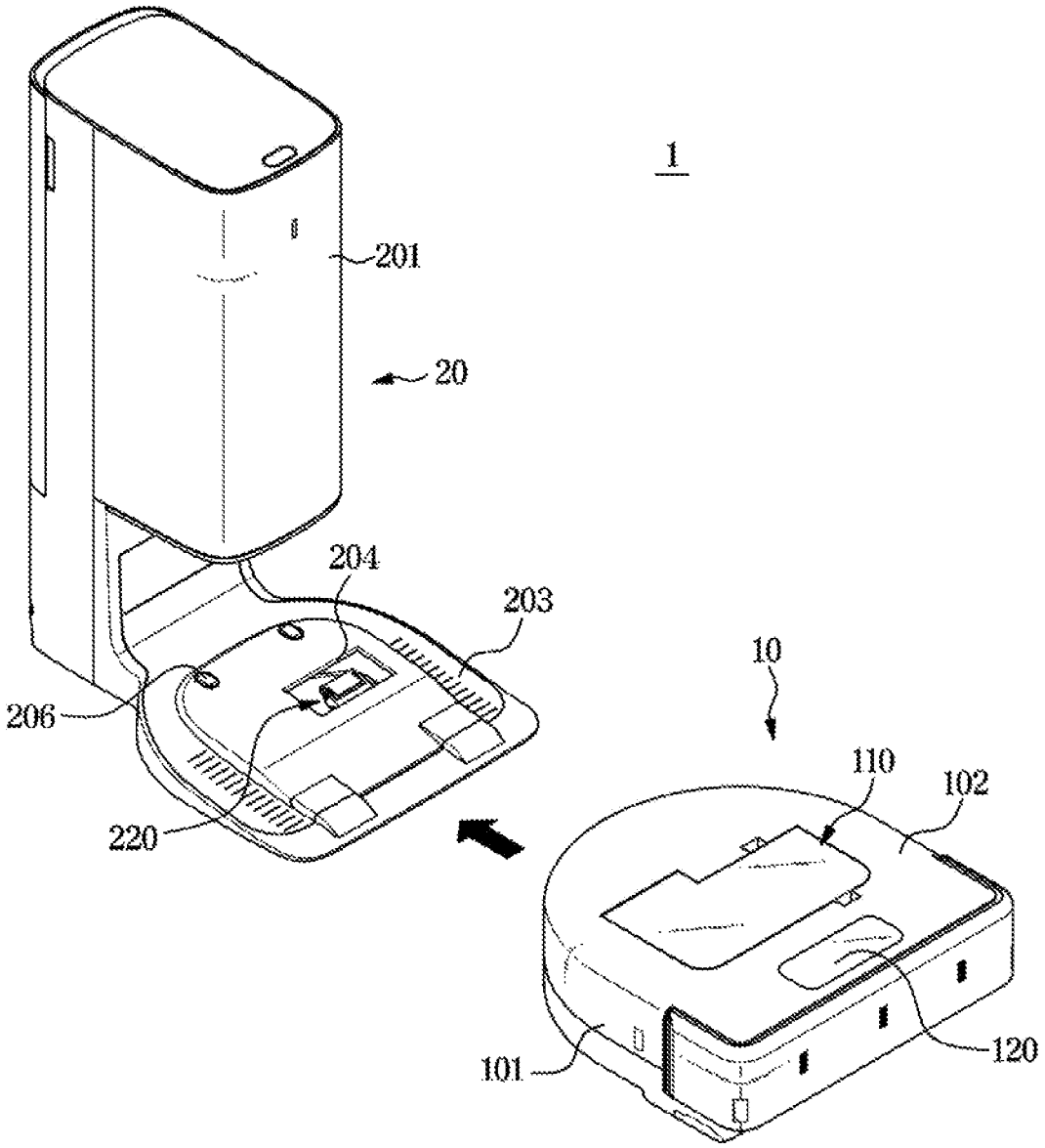
FIG. 1 is a view illustrating a cleaning system according to an embodiment of the disclosure, which shows a state in which a robot cleaner is separated from a station.

The embodiments set forth herein and illustrated in the configuration of the disclosure are only the most preferred embodiments and are not representative of the full the technical spirit of the disclosure, so it should be understood that they may be replaced with various equivalents and modifications at the time of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~and/or~," or the like.

The terms "front", "rear", "upper", "lower", "top", and "bottom" as herein used are defined with respect to the drawings, but the terms may not restrict the shape and position of the respective components.

It is an object of the disclosure to provide a cleaning system capable of automatically removing dust collected in the robot cleaner.

It is another object of the disclosure to provide a cleaning system capable of preventing a station from being entangled in a collecting path when collecting dirt from a dust collecting chamber of a robot cleaner.

It is another object of the disclosure to provide a cleaning system capable of preventing an outlet door of a robot cleaner from being opened due to malfunction.

Specifically, as illustrated in FIG. 1, the direction in which the robot cleaner 10 is docked to the station 20 is defined as the rear side, and based on the rear side direction, front, left and right sides, and upper and lower sides are defined.

Hereinafter, with reference to the accompanying drawings an embodiment according to the disclosure will be described in detail.

Figure 2:
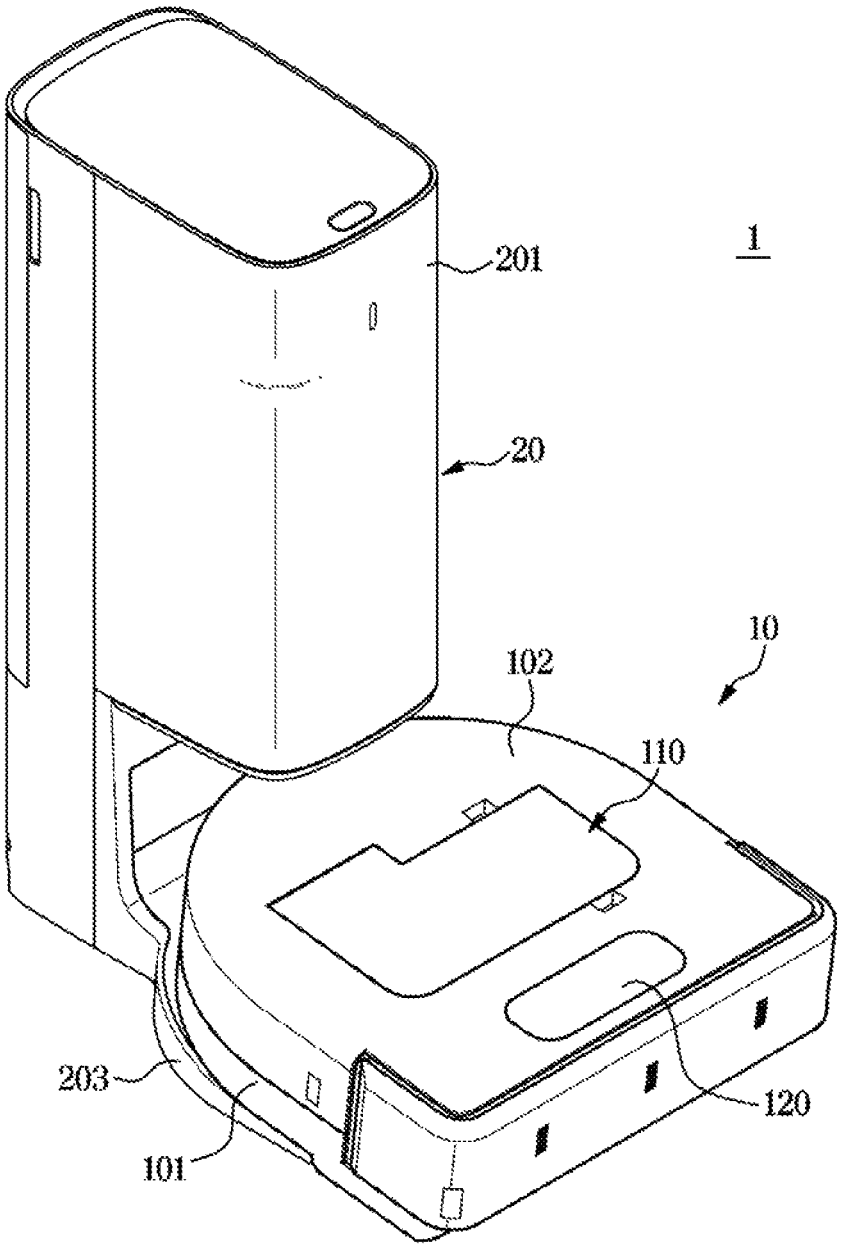
FIG. 2 is a view illustrating a state in which the robot cleaner shown in FIG. 1 is seated on the station.

FIG. 1 is a view illustrating a cleaning system according to an embodiment of the disclosure, which shows a state in which a robot cleaner is separated from a station. FIG. 2 is a view illustrating a state in which the robot cleaner of FIG. 1 is seated on the station.

Referring to FIGS. 1 and 2, the cleaning system 1 may include a robot cleaner 10 and a station 20.

The robot cleaner 10 may clean a floor surface while moving along the floor surface. The floor surface cleaned by the robot cleaner 10 may be referred to as a surface to be cleaned. The robot cleaner 10 may move to the station 20 as shown in FIG. 2 when charging is required or when the inside of a dust collecting chamber (111 in FIG. 3) is full and needs to be emptied.

The station 20 may be provided to mount the robot cleaner 10 thereon. The station 20 may include a cleaner seating portion 203 on which the robot cleaner 10 is seated. The station 20, when the robot cleaner 10 is seated on the cleaner seating portion 203, may charge a battery (107 in FIG. 3) of the robot cleaner 10 or collect dirt collected in the dust collecting chamber 111 of the robot cleaner 10.

The cleaner seating portion 203 may be provided with a connection opening 204 connected to one end of a guide member (213 in FIG. 5) and allowing a collecting path (P in FIG. 5) to be communicate with the outside.

Figure 3:
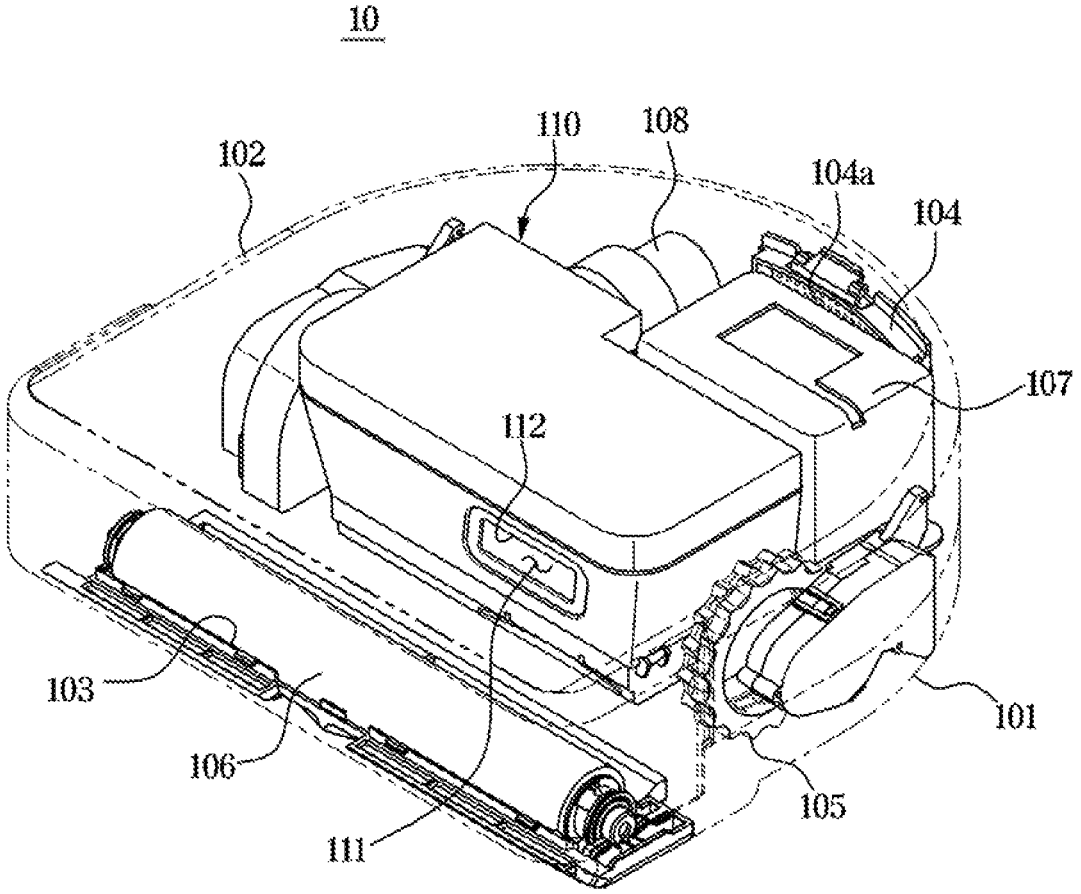
FIG. 3 is a view illustrating the interior of the robot cleaner shown in FIG. 1.
Figure 4:
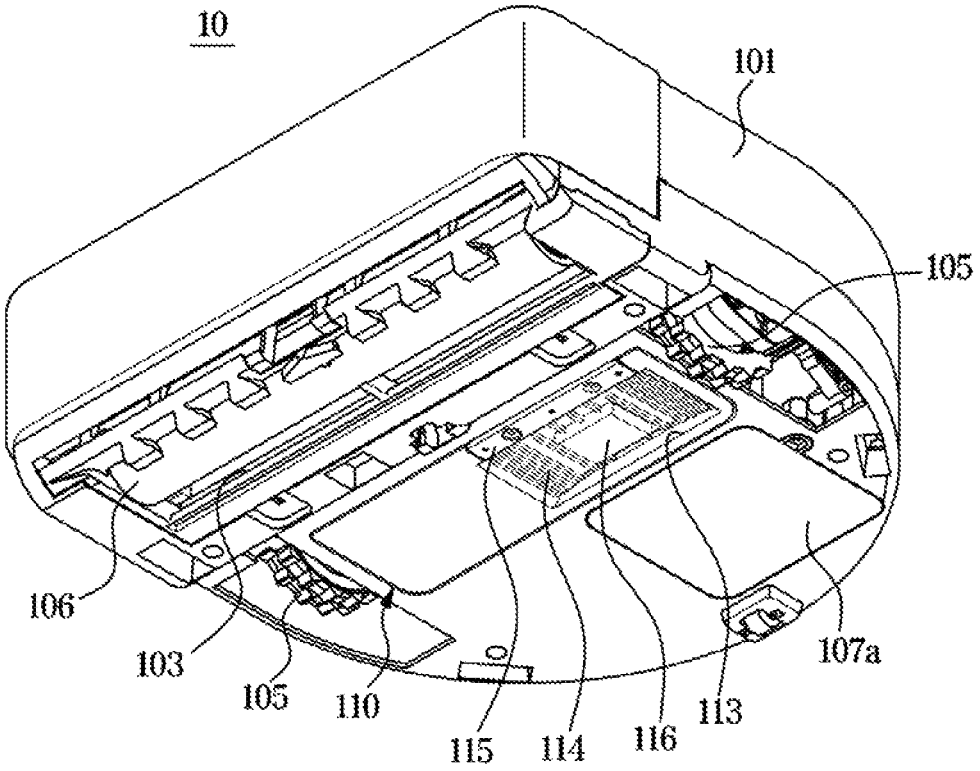
FIG. 4 is a view illustrating a lower portion of the robot cleaner shown in FIG. 3.

FIG. 3 is a view illustrating the interior of the robot cleaner shown in FIG. 1. FIG. 4 is a view illustrating a lower portion of the robot cleaner shown in FIG. 3.

Referring to FIGS. 3 and 4, the robot cleaner 10 may include a cleaner housing 101 in which an accommodating space is formed and a cleaner cover 102 covering an open top surface of the cleaner housing 101. The cleaner housing 101 may have electrical components disposed therein. The cleaner cover 102 may be detachably coupled to the cleaner housing 101.

The cleaner housing 101 may be provided with a cleaner inlet 103. The cleaner inlet 103 may be formed to face the surface to be cleaned. The cleaner inlet 103 may be formed through a bottom surface of the cleaner housing 101. Dirt on the surface to be cleaned may be introduced into a dust collecting device 110 together with air through the cleaner inlet 103.

The cleaner inlet 103 may be provided with a drum blade 106 disposed thereon. The drum blade 106 may be rotatably mounted with respect to the cleaner housing 101. The drum blade 106 may scatter dirt by hitting the surface to be cleaned. The scattered dirt may be introduced into the cleaner inlet 103 together with surrounding air.

The dirt and/or air introduced through the cleaner inlet 103 may move to the dust collecting device 110. The dirt and/or air may move to the dust collecting chamber 111 through a dirt inlet 112.

The cleaning housing 101 may be provided with a cleaner outlet 104. The cleaner outlet 104 may be located on the rear side surface of the robot cleaner 10. The cleaner outlet 104 may discharge air introduced through the cleaner inlet 103 by the suction force generated by a cleaner suction device 108 to the outside of the robot cleaner 10. The cleaner outlet 104 may include a cleaner outlet port 104*a* provided as a plurality of through holes.

The robot cleaner 10 may include a cleaner wheel 105. The cleaner wheel 105 may be configured to move the robot cleaner 10. The cleaner wheel 105 may rotate by receiving power from a wheel driving device (not shown). Although the cleaner wheels 105 are illustrated as being provided on the left and right sides of the robot cleaner 10, respectively, the arrangement position of the cleaner wheels 105 is not limited thereto.

The robot cleaner 10 may include a battery 107. The battery 107 may be provided to be rechargeable. The battery 107 may provide power required to drive the robot cleaner 10.

The cleaner housing 101 may be provided with a battery cover 107*a* detachably mounted on the bottom surface thereof. The battery cover 107*a* is removed from the cleaner housing 101, enabling the battery 107 to be separated from the robot cleaner 10.

The robot cleaner 10 may include the cleaner suction device 108. The cleaner suction device 108 may be provided as a fan motor device. The cleaner suction device 108 may generate suction power for suctioning dirt and/or air on the surface to be cleaned through the cleaner inlet 103. The cleaner suction device 108 may be arranged to communicate with an air outlet (not shown) of the dust collecting device 110. The cleaner suction device 108 may be disposed on an air path between the cleaner inlet 103 and the cleaner outlet 104.

The dust collecting device 110 may be configured to filter and collect the dirt introduced through the cleaner inlet 103. The dust collecting device 110 includes the dust collecting chamber 111 in which dirt is collected, the dirt inlet 112 through which dirt and/or air is introduced, a dirt outlet 113 through which dirt is discharged to the station 20, an outlet door 114 for opening and closing the dirt outlet 113, a door support 115 supporting the outlet door 114, and a door magnetic body 116 provided in the outlet door 114.

The dust collecting chamber 111 may collect dust that has been separated from air containing the dust suctioned by the robot cleaner 10. The dust collecting chamber 111 may communicate with the outside through the dirt outlet 113. A device for separating dirt from the air may be disposed in the dust collecting chamber 111. A cyclone unit (not shown) may be disposed in the dust collecting chamber 111.

The dirt outlet 113 may be opened and closed by the outlet door 114. The dirt outlet 113 may be formed on a bottom surface of the dust collecting chamber 111. The dirt outlet 113 may selectively communicate with a guide member 213 of the station 20.

The outlet door 114 may rotate with respect to the dust collecting device 110 to open and close the dirt outlet 113. One end of the outlet door 114 may be fixed to the door support 115 provided at a lower side of the dust collecting device 110.

The outlet door 114 may be formed of an elastic material. The outlet door 114 may be elastically biased in a direction of the dirt outlet 113 being closed by the elasticity of the outlet door 14. The door support 115 may support the one end of the outlet door 114 so that the outlet door 114 is kept in a position in which the dirt outlet 113 is closed.

The door magnetic body 116 may include a magnet. The door magnetic body 116 may be provided to correspond to a lever magnetic body 229 of a lever device 220. The door magnetic body 116 may be provided to allow an attractive force to act with the lever magnetic body 229. The door magnetic body 116 may be located at an approximately central portion of the outlet door 114.

The air having dust filtered out by the dust collecting device 110 may pass through the air outlet by the suction force of the cleaner suction device 108 and move to the cleaner outlet 104.

The robot cleaner 10 may include a display 120. The display 120 may display a driving state of the robot cleaner 10. The display 120 may be provided as a touch screen to receive a user's command. The display 120 may be located at an end portion of the robot cleaner 10 facing away from a direction in which the robot cleaner 10 is docked to the station 20. Specifically, referring to FIGS. 1 and 2, when the robot cleaner 10 reverses and docks to the station 20, the display 120 located at the front end of the robot cleaner 10 may be exposed to the user even after the robot cleaner 10 is docked to the station 20.

Figure 5:
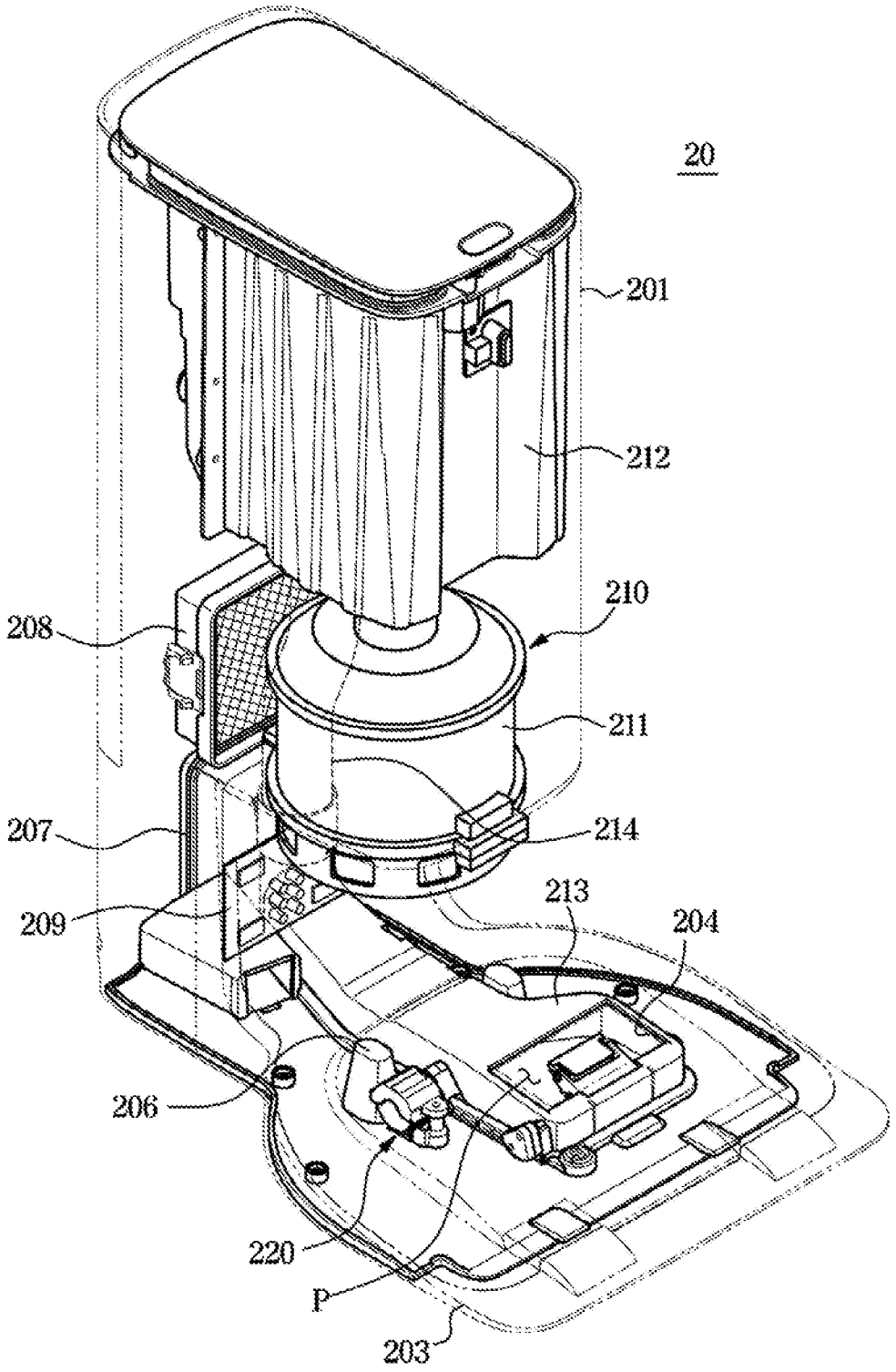
FIG. 5 is a view illustrating the interior of the station shown in FIG. 1.
Figure 6:
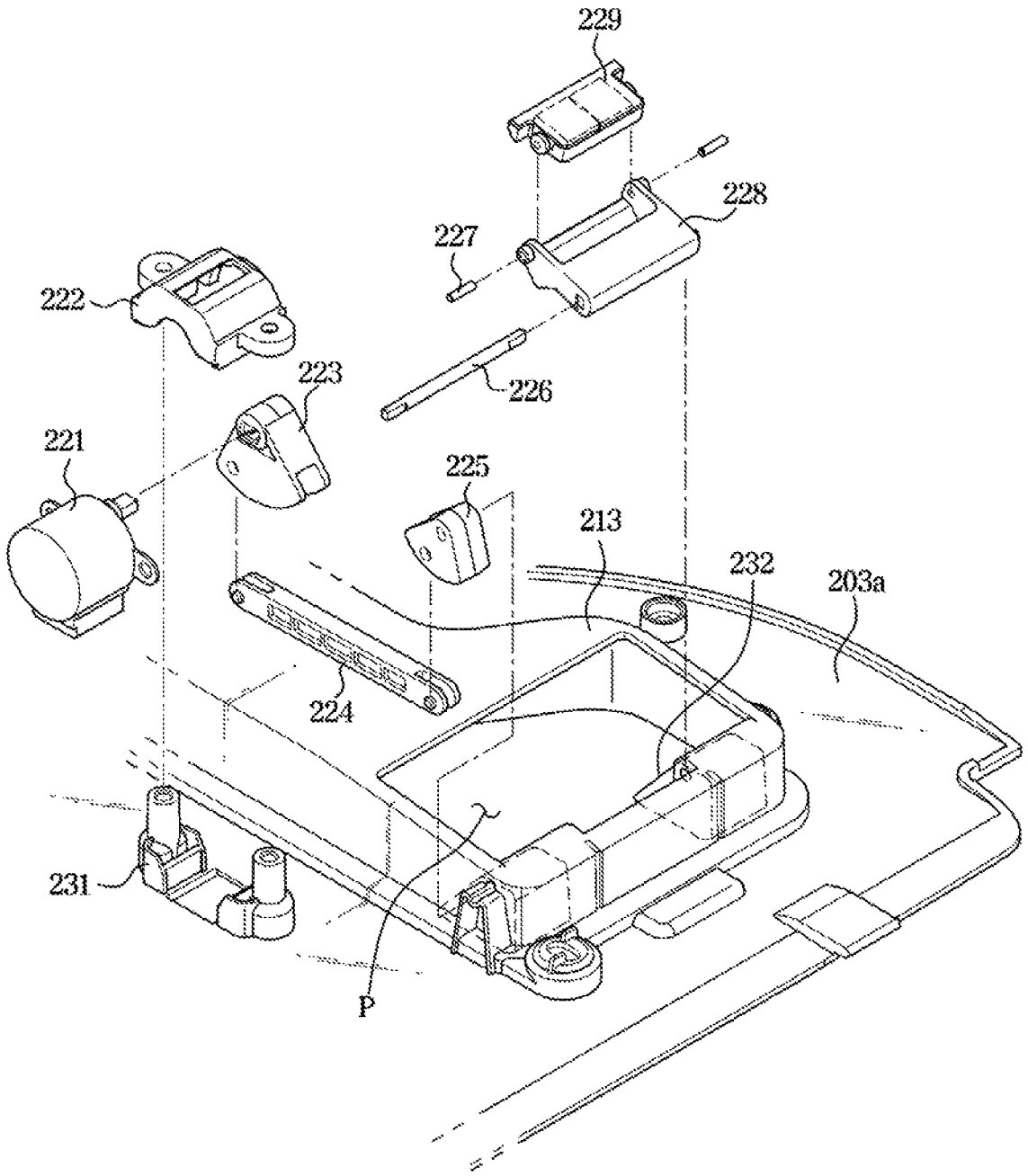
FIG. 6 is an exploded view illustrating a lever device shown in FIG. 5.

FIG. 5 is a view illustrating the interior of the station shown in FIG. 1. FIG. 6 is an exploded view illustrating a lever device shown in FIG. 5.

Referring to FIG. 5, the station 20 may include a station housing 201 in which an accommodating space is formed and a cleaner seating portion 203 on which the robot cleaner 10 is mounted.

Inside the station housing 201, at least a portion of the collecting device 210 for collecting dirt that has been collected by the dust collecting chamber 111 of the robot cleaner 10 may be disposed. Electrical components for charging the battery 107 of the robot cleaner 10 may be disposed inside the station housing 201.

Figure 12:
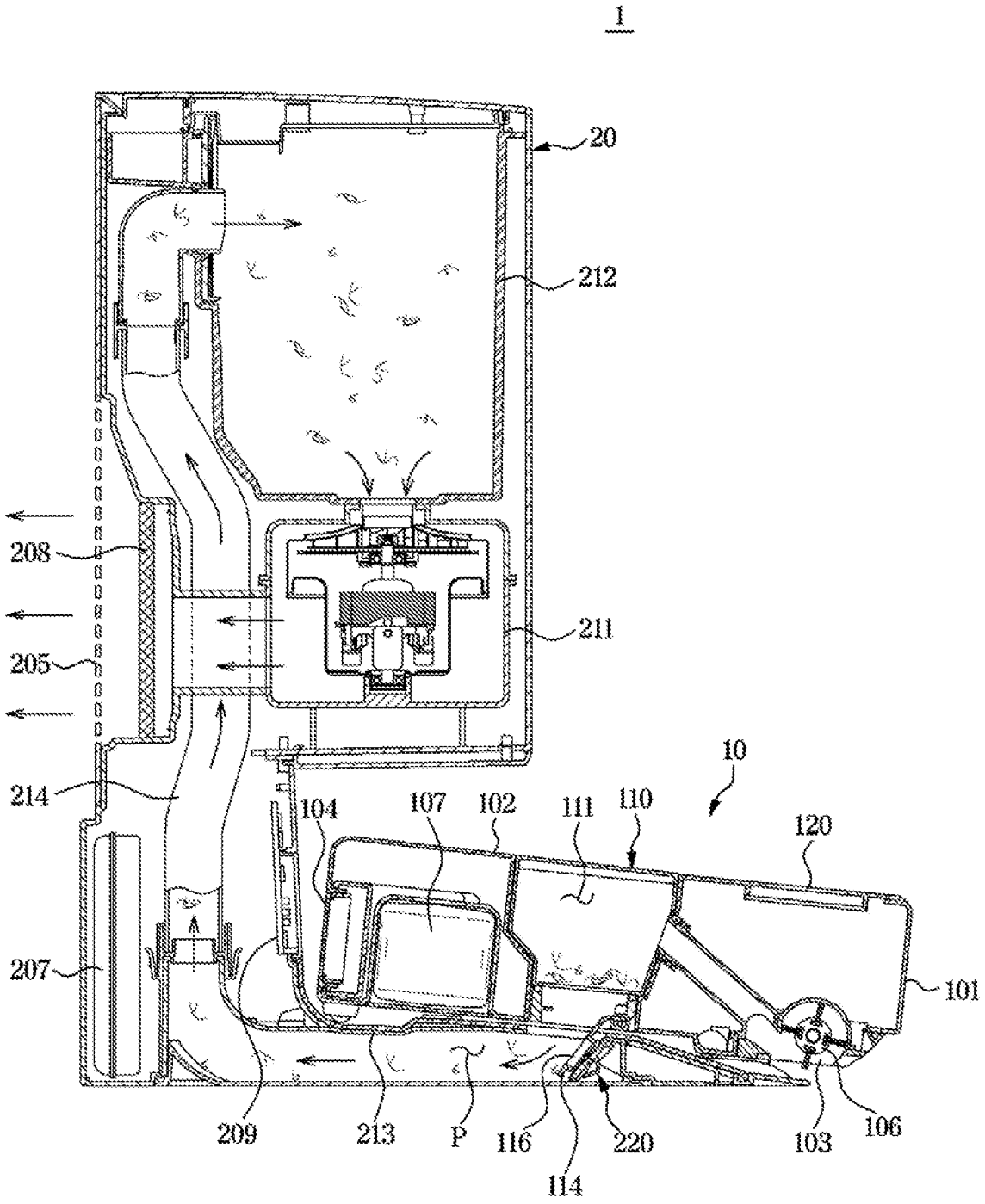
FIG. 12 is a view illustrating a path for collecting dirt from the station of the cleaning system shown in FIG. 1.

The station housing 201 may be formed with a station outlet (205 in FIG. 12). The station outlet 205 may be provided so that air suctioned from the dust collecting chamber 111 of the robot cleaner 10 by a station suction device 211 is discharged to the outside of the station 20 through the station outlet 205. The station outlet 205 may be disposed on the rear surface of the station housing 201.

The station housing 201 may be provided with a discharge filter 208 arranged to filter air discharged through the station outlet 205. The discharge filter 208 may be arranged to filter air discharged from the station suction device 211. The discharge filter 208 may be disposed adjacent to the station outlet 205. The discharge filter 208 may include a high efficiency particulate air (HEPA) filter.

The station housing 201 may be provided with a station power board 207. The station power board 207 may be configured to receive power from the outside and convert the received power to suit the station 20. The station power board 207 may be located at the rear lower side of the station housing 201.

The station housing 201 may be provided with a station controller 209. The station controller 209 may be electrically connected to the station power board 207 of the station 209. The station controller 209 may control the lever device 220. The station controller 209 may control a lever driving source 221 to be driven when the robot cleaner 10 is seated on the station 20. The station controller 209 may control the station suction device 211. The station controller 209 may control a station charging terminal 206.

The collecting device 210 is configured to, when the lever device 220 opens the outlet door 114, causing the guide member 213 and the dust collecting chamber 111 of the robot cleaner 10 to communicate with each other, collect dirt collected in the dust collecting chamber 111. The collecting device 210 may include the station suction device 211, a collecting chamber 212, the guide member 213, and an extension member 214.

The station suction device 211 is configured to, when the robot cleaner 10 is seated on the station 20, that is, when the dust collecting chamber 111 communicates with the guide member 213, generate suction power for suctioning dirt of the dust collecting chamber 111. The station suction device 211 suctions dirt and/or air from the dust collecting chamber 111 of the robot cleaner 10, collecting the dirt into the collecting chamber 212, and discharging air to the outside through the station outlet 205.

The collecting chamber 212 may filter out the dirt from the dirt and/or air introduced into the station 20 by the station suction device 211, and collect the dirt. The collecting chamber 212 may be provided with a device (not shown) for filtering out dirt from the dirt and/or air guided by the guide member 213 and the extension member 214.

The guide member 213 and the extension member 214 may be provided to guide dirt flowing into the connection opening 204 to the collecting chamber 212.

The guide member 213 may extend in a substantially horizontal direction with respect to the cleaner seating portion 203. One end of the guide member 213 may be connected to the connection opening 204, and the other end of the guide member 213 may be connected to one end of the extension member 214. On the one end of the guide member 213 connected to the connection opening 204, a lever 228 of the lever device 220 may be located.

The extension member 214 may extend approximately in the vertical direction at a rear side of the station housing 201. One end of the extension member 214 may be connected to the guide member 213, and the other end of the extension member 214 may be connected to the collecting chamber 212.

The cleaner seating portion 203 may be provided to allow the robot cleaner 10 to be seated thereon. The cleaner seating portion 203 may support a lower portion of the station housing 201.

The cleaner seating portion 203 may be provided with the station charging terminal 206 for charging the battery 107 of the robot cleaner 10. The station charging terminal 206 may be electrically connected to the battery 107 of the robot cleaner 10 to supply power to the battery 107 when the robot cleaner 10 is seated on the cleaner seating portion 203. The station charging terminal 206 may charge the battery 107 of the robot cleaner 10 in a wireless charging method.

Referring to FIG. 6, the lever device 220 may be disposed in the cleaner seating portion 203. The lever device 220 may be provided for the collecting device 210 to selectively communicate with the dust collecting chamber 111 of the robot cleaner 10. The lever device 220 may be configured to open the outlet door 114 when the robot cleaner 10 is seated on the cleaner seating portion 203. The lever device 220 may include the lever driving source 221, a first link 223, a connecting member 224, a second link 225, and the lever 228.

The lever driving source 221 may be provided to generate power for driving the lever 228. The lever driving source 221 may include a motor capable of rotating in both directions.

The lever driving source 221 may be fixed to a driving source fixing portion 231 provided on a seating portion base 203*a* of the cleaner seating portion 203. The lever driving source 221 fixed to the driving source fixing portion 231 may be covered by a driving source cover 222.

The first link 223 may be rotated by receiving power from the lever driving source 221. The first link 223 may rotate in both directions as the lever driving source 221 rotates in both directions.

The first link 223 may be rotatably coupled to the connecting member 224. The connecting member 224 may move in the front-rear direction as the first link 223 rotates. The connecting member 224 may transmit power of the first link 223 to the second link 225. One end of the connecting member 224 may be rotatably coupled to the first link 223, and the other end of the connecting member 224 may be rotatably coupled to the second link 225.

The second link 225 may be rotatably coupled to the connecting member 224. The second link 225 may be rotated as the connecting member 224 moves. The second link 225 may be rotated in both directions as the connecting member 224 is moved in the front-rear direction.

A first shaft 226 may connect the second link 225 to the lever 228. Through the first shaft 226, the lever 228 may rotate at the same time as rotation of the second link 225.

The lever 228 may be rotatably coupled to the guide member 213. The lever 228 may be provided to rotate as the second link 225 rotates. The lever 228 may be provided to be fixed to the outlet door 114 as the lever driving source 221 is driven. The lever 228 may be provided to be fixed to the outlet door 114 when the lever device 220 opens the outlet door 114 so that the collecting device 210 communicates with the dust collecting device 110.

The lever 228 may be provided to be movable between a first position in which the lever 228 contacts the outlet door 114 with the outlet door 114 closed and a second position in which the outlet door 114 is opened. The second position may be set to form an angle of approximately 55 degrees with respect to the first position.

The lever 228 may include the lever magnetic body 229 provided to allow an attractive force to act with the door magnetic body 116. The lever magnetic body 229 may include a magnet. The lever magnetic body 229 may be provided to correspond to the door magnetic body 116 of the outlet door 114.

The lever magnetic body 229 may be rotatably coupled to the lever 228. A second shaft 227 may support the lever magnetic body 229 to be rotatable relative to the lever 228. Since the lever magnetic body 229 is provided to be rotatable relative to the lever 228, the lever 228 may open and close the outlet door 114 while in close contact with the outlet door 114.

The lever 228 may move from the second position to a third position opposite to the first position. When the lever 228 moves to the third position while in contact with the outlet door 114, the outlet door 114 may be separated from the lever 228. That is, the third position is a position set to separate the outlet door 114 from the lever 228. The third position may be set to form an angle of approximately 10 degrees with respect to the second position. That is, the third position may be set to form an angle of approximately 65 degrees with respect to the first position.

Specifically, the seating portion base 203*a* may be provided with a release member 232. The release member 232 may be located on the collecting path P formed between the seating portion base 203*a* and the guide member 213. The release member 232 may restrict the movement of opposite ends of the outlet door 114 when the lever 228 moves from the second position to the third position. As the release member 232 restricts movement of the opposite ends of the outlet door 114, the release member 232 stops rotating, and the lever 228 is separated from the release member 232 and rotated. To this end, the release member 232 may have an inclined surface at an angle substantially similar to an angle of the lever 228 inclined with respect to the seating portion base 203*a* when the lever 228 is in the second position.

Figure 7:
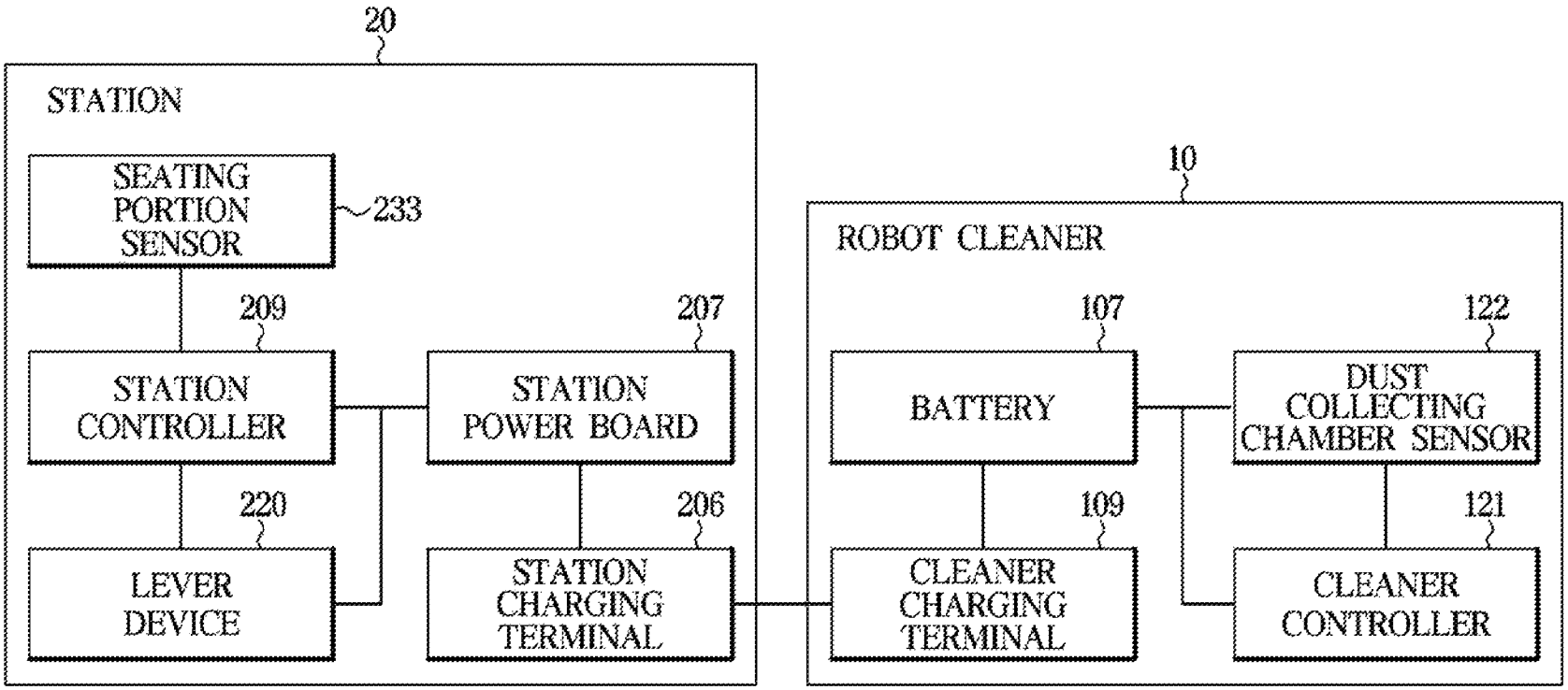
FIG. 7 is a view illustrating an electrical connection between the robot cleaner and the station shown in FIG. 1.

FIG. 7 is a view illustrating an electrical connection between the robot cleaner and the station shown in FIG. 1.

The robot cleaner 10 may include a cleaner charging terminal 109 that is electrically connected to the battery 107 when the battery 107 is mounted on the robot cleaner 10.

The station 20 includes the station charging terminal 206 electrically connected to the cleaner charging terminal 109 to charge the battery 107 of the robot cleaner 10 and the station power board 207 electrically connected to the station charging terminal 206 and provided to be supplied with power from the outside.

With such a configuration, the robot cleaner 10, when mounted on the station 20, may charge the battery 107.

The robot cleaner 10 may include a dust collecting chamber sensor 122 provided to measure the amount of dirt collected in the dust collecting chamber 111.

The dust collecting chamber sensor 122 may include an infrared sensor. The dust collecting chamber sensor 122, upon detecting that the amount of dirt collected inside the dust collecting chamber 111 has reached a preset amount, may transmit information to the cleaner controller 121, and the cleaner controller 121 may perform control to cause the robot cleaner 10 to move to the station 20 on the basis of the information received from the dust collecting chamber sensor 122.

The station 20 may include a seating portion sensor 233 provided on the cleaner seating portion 203. The seat portion sensor 233 may be configured to detect whether the robot cleaner 10 is seated on the cleaner seating portion 203. The seating portion sensor 233, upon detecting that the robot cleaner 10 is seated on the cleaner seating portion 203, may transmit the corresponding information to the station controller 209.

The station controller 209 may drive the lever device 220 on the basis of the information received from the seating portion sensor 223. The station controller 209 may drive the lever device 220 to open the outlet door 114 of the robot cleaner 10.

Figure 8:
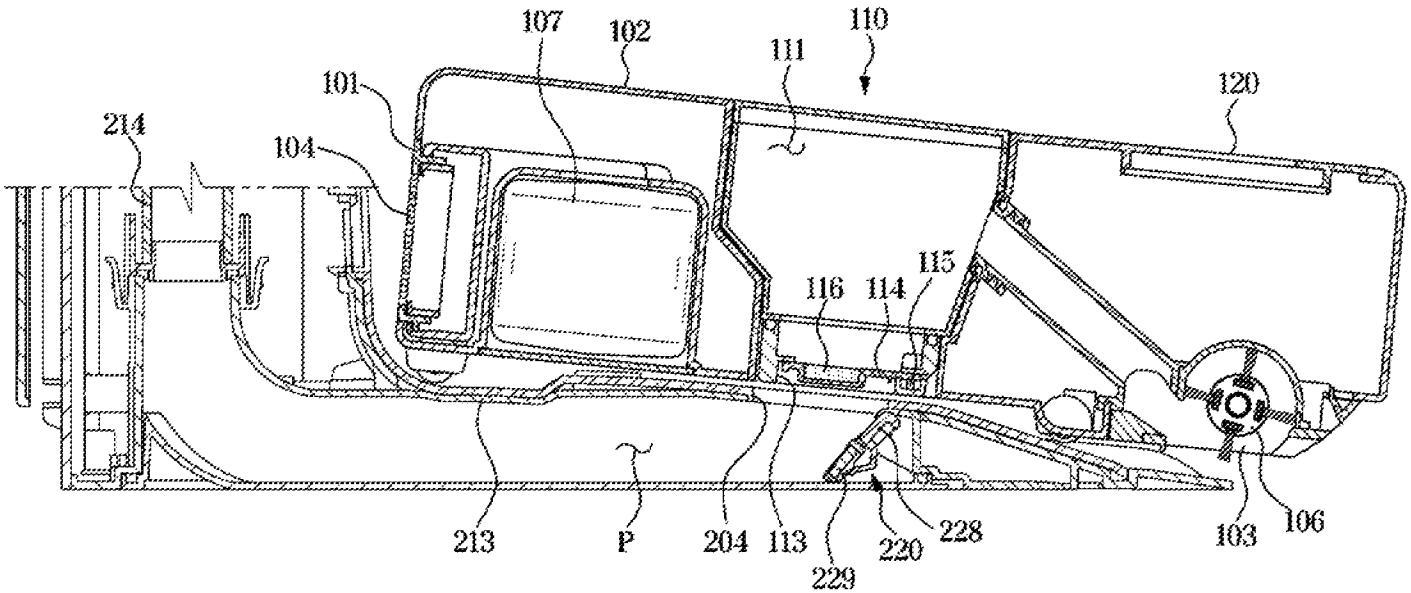
FIG. 8 is a cross-sectional view illustrating a state in which the robot cleaner shown in FIG. 2 is seated on the station.
Figure 9:
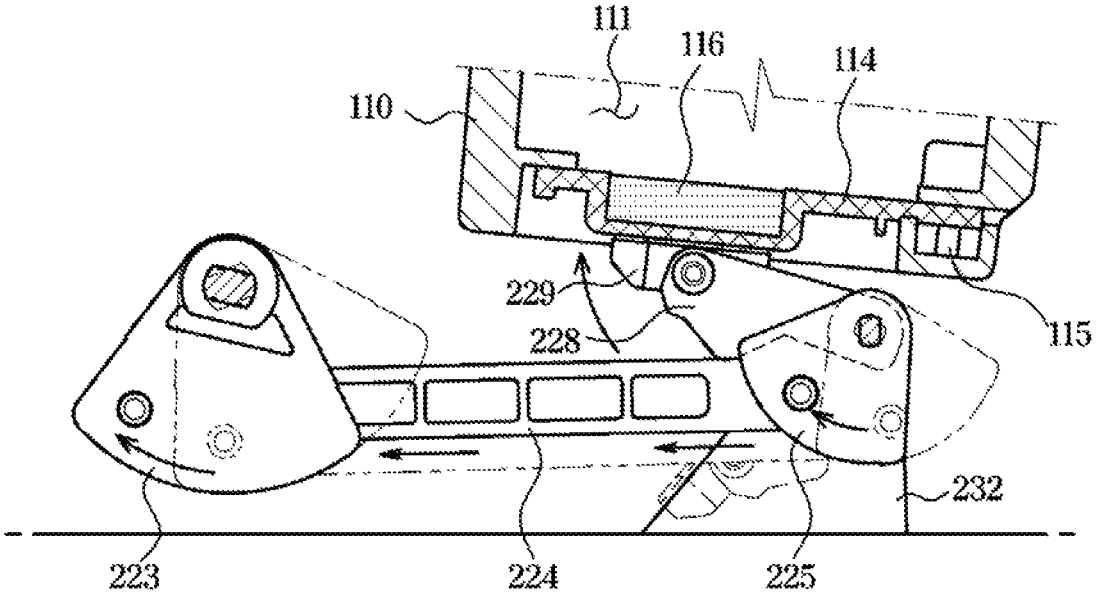
FIG. 9 is an enlarged view illustrating a state in which a lever shown in FIG. 8 is located in a first position.
Figure 10:
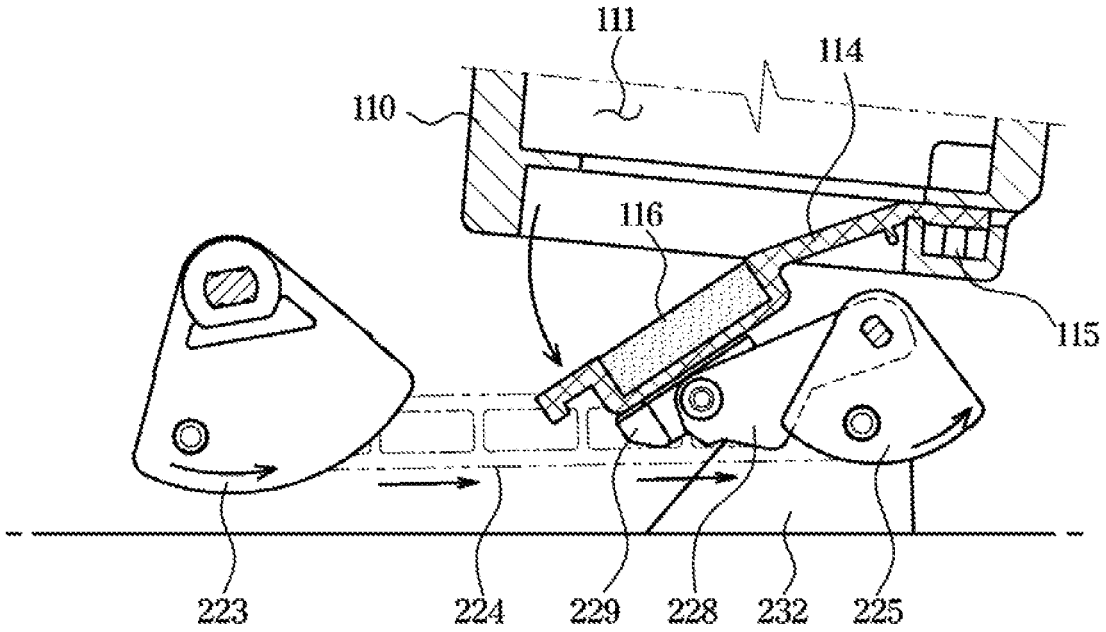
FIG. 10 is an enlarged view illustrating a state in which the lever shown in FIG. 8 is located in the second position.
Figure 11:
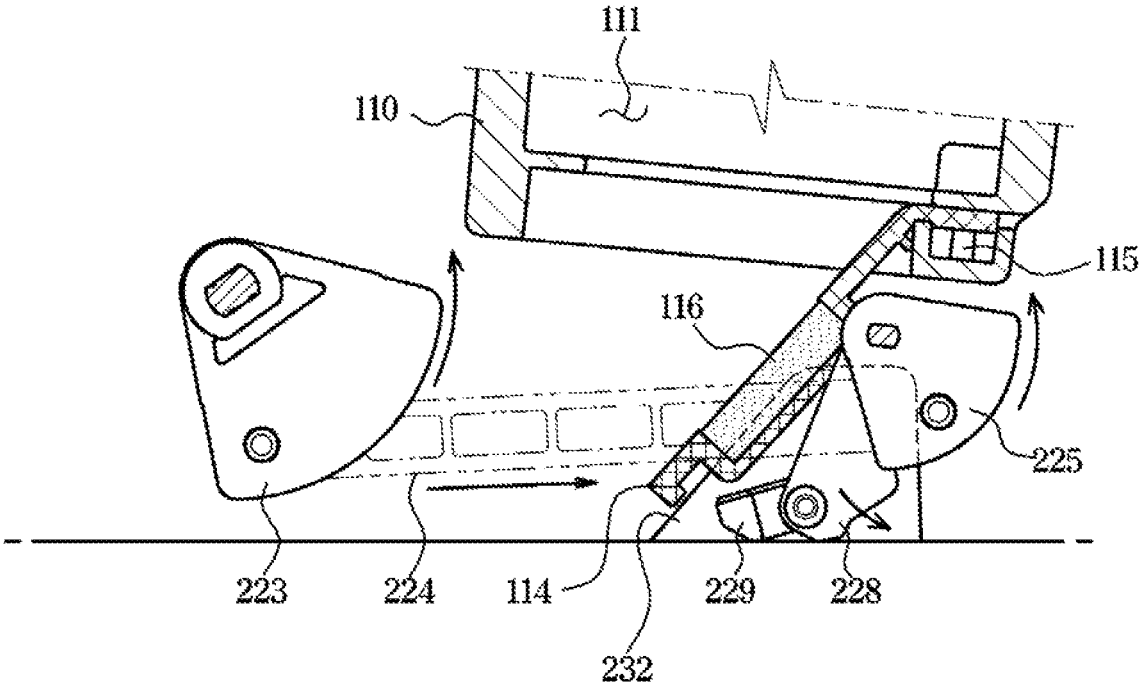
FIG. 11 is an enlarged view illustrating a state in which the lever shown in FIG. 8 is located in the third position.

FIG. 8 is a cross-sectional view illustrating a state in which the robot cleaner shown in FIG. 2 is seated on the station. FIG. 9 is an enlarged view illustrating a state in which a lever shown in FIG. 8 is located in a first position. FIG. 10 is an enlarged view illustrating a state in which the lever shown in FIG. 8 is located in the second position. FIG. 11 is an enlarged view illustrating a state in which the lever shown in FIG. 8 is located in the third position.

Referring to FIG. 8, when the amount of dirt collected in the dust collecting device 110 reaches a preset amount, the robot cleaner 10 moves to the cleaner seating portion 203 of the station 20.

The seating portion sensor 233 of the station 20 detects that the robot cleaner 10 is located in the cleaner seating portion 203, and transmits the corresponding information to the station controller 209. The station controller 209 controls the lever driving source 221 of the lever device 220 to be driven. In addition, the station controller 209 may control the station charging terminal 206 to charge the battery 107 of the robot cleaner 10.

Specifically, referring to FIG. 9, the station controller 209 may perform control to cause the lever driving source 221 to be driven such that the lever 228 moves to the first position. The station controller 209 may allow the lever 228 to be moved toward the outlet door 114. The lever 228 is located in the second position or the third position when the lever device 220 is not driven. As the lever 228 moves from the second position or the third position to the first position, the lever magnetic body 228 may become close to the door magnetic body 116 to exert an attractive force between the door magnetic body 116 and the lever magnetic body 228. Accordingly, the lever 228 is fixed to the outlet door 114.

Thereafter, referring to FIG. 10, the station controller 209 perform control to cause the lever driving source 221 to be driven such that the lever 228 moves from the first position to the second position. In this case, since the outlet door 114 is fixed to the lever 228, rotation of the lever 228 from the first position to the second position causes the outlet door 114 to rotate together with the lever 228, opening the dirt outlet 113. As such, components of the lever device 220, except for the lever 228 configured to open the outlet door 114, are disposed outside the collecting path P, and the lever 228 is in a position where the lever 228 is covered by the outlet door 114. Therefore, when the outlet door 114 is opened, no structure is located on the collecting path P, and thus the disclosure may prevent the entanglement of dirt on the collecting path P.

In order to implement such a driving operation, the disclosure may set the magnitude of the attractive force between the door magnetic body 116 and the lever magnetic body 229 to be larger than the magnitude of the elastic force for keeping the dirt outlet 113 closed by the outlet door 114.

Then, referring to FIG. 11, when the dust collecting of the dust collecting device 110 is completed, the station controller 209 controls the lever driving source 221 to move the lever 228 from the second position to the third position. Accordingly, the lever 228 may be further rotated in the direction of the outlet door 114 being opened. When the lever 228 rotates from the second position to the third position, the opposite ends of the outlet door 114 are restricted in rotation by the release member 232. In this case, since the outlet door 114 is formed of a material having elasticity, a central portion of the outlet door 114, on which the lever magnetic body 229 is disposed, may be moved along the lever 228, causing the outlet door 114 to be slightly deformed. Accordingly, the lever 228 may be set to be rotatable to an extent that the lever 228 is separated from the outlet door 114. Accordingly, the lever 228 is separated from the outlet door 114, rotating to the third position.

The cleaning system 1 according to the embodiment of the disclosure has the door magnetic body 116 and the lever magnetic body 229 on the outlet door 114 and the lever 228, respectively, and allows the lever 228 on the second position to be further moved in a direction of the outlet door 114 being opened, and thus the outlet door 144 and the lever 228 may be easily fixed to and released from each other.

In addition, the cleaning system 1 according to the embodiment of the disclosure may allow the outlet door 114 to be opened when the lever driving source 221 is driven under the control of the station controller 209, thereby preventing the outlet door 114 from being opened in inappropriate situations.

Referring to FIG. 12, as the lever device 220 opens the outlet door 114, the collecting device 210 suctions dirt inside the dust collecting device 110. The dust in the dust collecting device 110 moves along the guide member 213 and the extension member 214 to the collecting chamber 212. The dirt is collected in the collecting chamber 212, and the dirt together with air passing through the station suction device 211 is filtered through the discharge filter 208 before being discharged through the station outlet 205. The air filtered by the discharge filter 208 is discharged to the outside through the station outlet 205.

Figure 13:
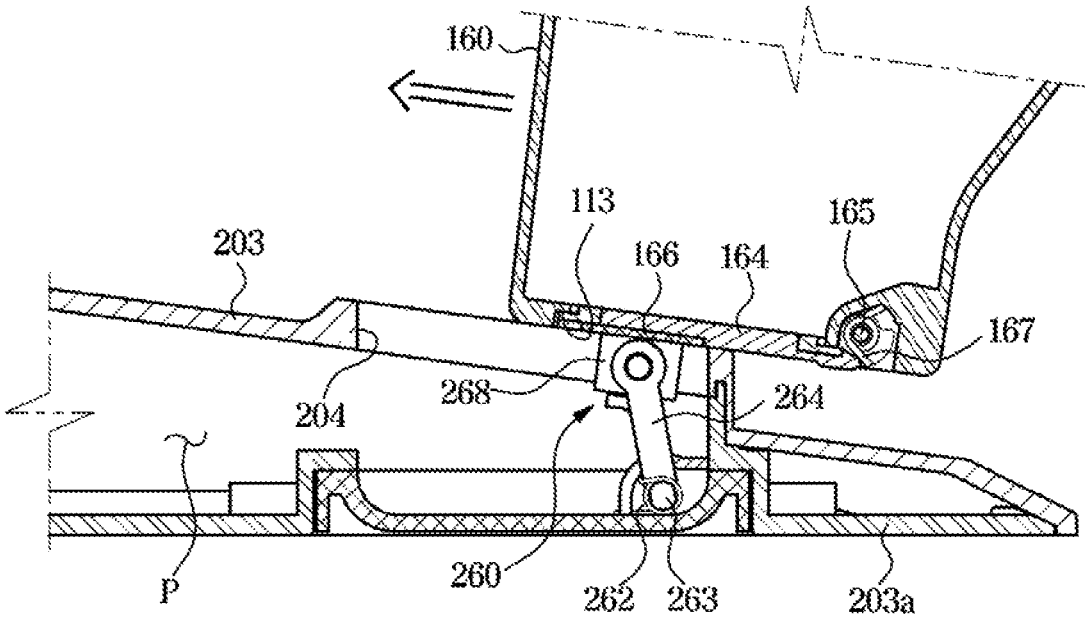
FIG. 13 is a view illustrating a process of opening and closing an outlet door according to another embodiment of the disclosure.
Figure 14:
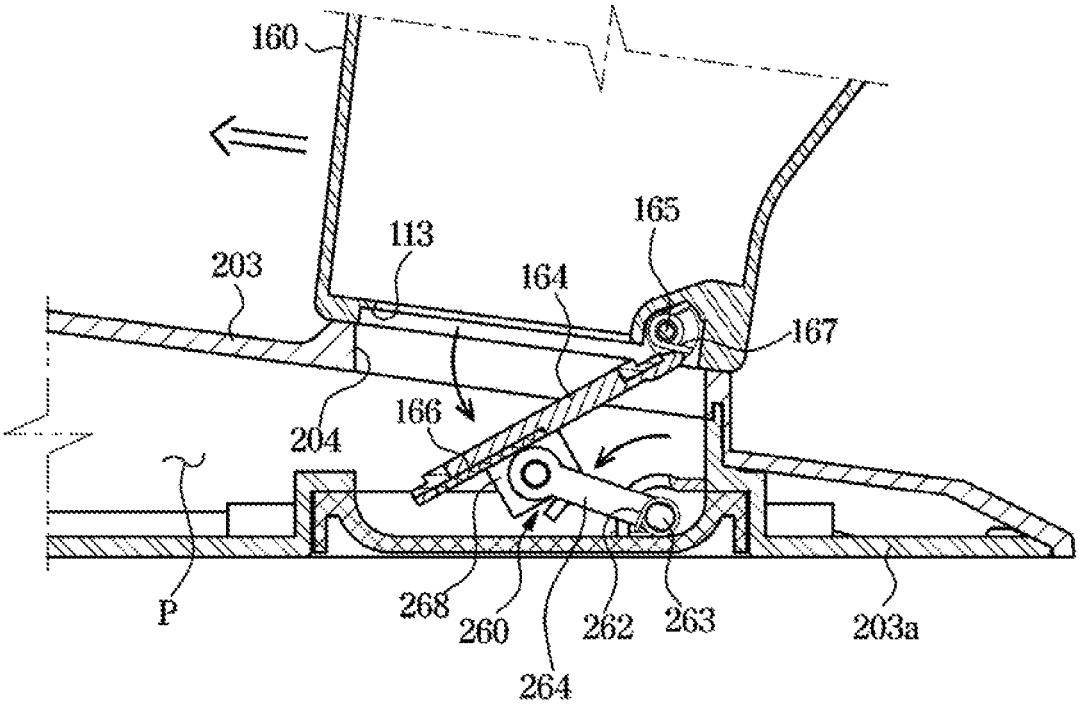
FIG. 14 is a view illustrating a process of opening and closing an outlet door according to another embodiment of the disclosure.

FIGS. 13 and 14 are a view illustrating a process of opening and closing an outlet door according to another embodiment of the disclosure.

Referring to FIGS. 13 and 14, a process of opening and closing an outlet door 164 according to the embodiment of the disclosure will be described. The same components as those in the embodiment shown in FIGS. 1 to 12 are assigned the same member numbers, and detailed descriptions may be omitted.

Referring to FIGS. 13 and 14, the outlet door 164 provided to open and close a dirt outlet 113 of a dust collecting device 160 may be provided with a door magnetic body 166. The outlet door 164 may be rotatably coupled to a door support 165. The outlet door 164 may be elastically biased in a direction of the dirt outlet 113 being closed by a door elastic member 167.

A lever device 260 may be disposed inside a cleaner seating portion 203. The lever device 260 may include a connecting member 264 rotatably provided on a lever support 263 of a seating portion base 203*a* and a lever 268 rotatably coupled to a connecting member 264.

The connecting member 264 may be elastically biased to a position in which the outlet door 164 is closed by the lever elastic member 262. The lever 268 may include a magnetic body.

As illustrated in FIG. 13, as the robot cleaner 10 enters the cleaner seating portion 203, the door magnetic body 166 provided in the outlet door 164 of the dust collecting device 160 may come into contact with the lever 268 of the lever device 260. In this case, an attractive force is generated between the door magnetic body 166 and the lever 268.

Thereafter, as illustrated in FIG. 14, while the robot cleaner 10 is moving to be completely seated on the cleaner seating portion 203, the lever 268 is kept in contact with the door magnetic body 166, which causes the connecting member 264 to rotate counterclockwise, and the outlet door 164 also to rotate counterclockwise. Accordingly, the outlet door 164 may be opened, and the dirt outlet 113 and the connection opening 204 may communicate with each other.

Thereafter, when the collecting of dirt having been collected in the dust collecting device 160 of the robot cleaner 10 is completed, the robot cleaner 10 moves to escape from the cleaner seating portion 203, and the outlet door 164 and the lever device 260 are moved shown in FIG. 13. That is, the outlet door 164 returns to a state of closing the dirt outlet 113 by the door elastic member 167, and the connecting member 264 may return to the first position of closing the outlet door 164 by the lever elastic member 262. Thereafter, the robot cleaner 10 completely escapes from the cleaner seating portion 203, and thus the door magnetic body 166 is separated from the lever 268.

With such a configuration, the lever 260 according to the embodiment of the disclosure may open and close the outlet door 164 in a simple mechanism.

As is apparent from the above, the cleaning system includes the lever device that is configured to open the outlet door when the robot cleaner is seated on the station, so that dust collected in the robot cleaner can be automatically emptied.

Since the cleaning system does not have an additional structure on a collecting path, thereby preventing dirt from being entangled on the collecting path.

Since the cleaning system has the station controller that controls the lever device to open the outlet door only in a preset condition, thereby preventing the outlet door from being opened due to malfunction.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

What is claimed is:

1. A cleaning system comprising:

a robot cleaner including a dust collecting device having a dirt outlet and an outlet door configured to open and close the dirt outlet; and a station including:

a collecting device configured to generate a suction force to suction dirt of the duct collecting device, and a lever device provided with a lever configured to be fixable to the outlet door as the outlet door is being opened to allow the collecting device and the dust collecting device to communicate with each other, and a lever driving source configured to generate power to drive the lever.

2. The cleaning system of claim 1, wherein the outlet door includes a door magnetic body, and the lever includes a lever magnetic body that allows an attractive force to act with the door magnetic body.

3. The cleaning system of claim 1, wherein the lever is movable between a first position in which the lever comes into contact with the outlet door that is in a closed state and a second position in which the lever moves with the outlet door as the outlet door is being opened.

4. The cleaning system of claim 3, wherein the lever is movable from the second position to a third position, and when the lever moves to the third position, the outlet door is separated from the lever.

5. The cleaning system of claim 4, wherein the lever device includes a release member configured to restrict a movement of the outlet door when the lever moves to the third position.

6. The cleaning system of claim 1, wherein the lever device includes:

a first link rotatable by receiving power from the lever driving source;

a connecting member moved by a rotation of the first link;

a second link rotatable by a movement of the connecting member; and a shaft configured to transfer rotary force of the second link to the lever.

7. The cleaning system of claim 1, wherein the outlet door is provided to be elastically biased in a direction toward the dirt outlet.

8. The cleaning system of claim 7, wherein the outlet door is formed of material having an elasticity, and the robot cleaner includes a door support that supports the outlet door in the direction toward the dirt outlet.

9. The cleaning system of claim 7, wherein the robot cleaner includes a door elastic member that elastically supports the outlet door in the direction toward the dirt outlet.

10. The cleaning system of claim 1, wherein the robot cleaner includes a display that is arranged at an end portion of the robot cleaner facing away from a direction in which the robot cleaner is docked to the station.

11. The cleaning system of claim 1, wherein the station includes a station controller configured to control the lever device, and the station controller is provided to drive the lever driving source when the robot cleaner is seated on the station.

12. The cleaning system of claim 11, wherein when the robot cleaner is seated on the station, the station controller controls the lever driving source for the lever to move toward the outlet door and be fixed to the outlet door, and then move the lever in a direction in which the outlet door opens to thereby open the outlet door.

13. The cleaning system of claim 12, wherein when collecting of dirt in the dust collecting device of the robot cleaner is completed, the station controller controls the lever driving source for the lever to further move in the direction in which the outlet door opens such that the outlet door is separated from the lever.

14. The cleaning system of claim 12, wherein the station includes a cleaner seating portion on which the robot cleaner is seated, and the cleaner seating portion is provided with a station charging terminal electrically connectable with the robot cleaner to charge a battery provided in the robot cleaner.

15. The cleaning system of claim 14, wherein the station controller controls the station to charge the battery when driving the lever driving source.

16. A station comprising:

a cleaner seating portion on which a robot cleaner is seated, the cleaner seating portion including a guide member configured to communicate with a dust collection device provided in the robot cleaner;

a collecting device configured to generate a suction force to suction dirt of the dust collecting device; and a lever device including:

a lever configured to be fixable to an outlet door provided to open and close the dust collecting device, the lever being fixed to the outlet door as the outlet door opens, and a lever driving source configured to generate power to drive the lever.

17. The station of claim 16, wherein the lever includes a lever magnetic body.

18. The station of claim 16, wherein the lever is movable to one of a first position in which the lever is fixed to the outlet door that is in a closed state, a second position in which the lever moves with the outlet door as the outlet door is being opened, and a third position in which the lever is separated from the outlet door.

19. The station of claim 16, further comprising:

a station controller configured to control the lever device while the robot cleaner is seated on the seating portion, wherein the station controller controls the lever driving source for the lever to move toward the outlet door and be fixed to the outlet door, and then move in a direction in which the outlet door opens to thereby open the outlet door.

20. A robot cleaner comprising:

a cleaner inlet formed to face a surface to be cleaned;

a cleaner suction device configured to generate a suction force to suction dirt;

a dust collecting device in which dirt introduced through the cleaner inlet is collected, the dust collecting device having a dirt outlet; and an outlet door configured to open and close the dirt outlet, the outlet door being configured to be elastically biased in a direction in which the dirt outlet is being opened, and to be moved due to a magnetic force applied to a door magnetic body of the outlet door.

* * * * *